US007527263B2

(12) United States Patent
DeGruchy et al.

(10) Patent No.: US 7,527,263 B2
(45) Date of Patent: May 5, 2009

(54) PRE-REGISTRATION APPARATUS

(75) Inventors: Paul J. DeGruchy, Hilton, NY (US); Henry T. Bober, Fairport, NY (US); Xinzhong Zhang, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 303 days.

(21) Appl. No.: 11/520,373

(22) Filed: Sep. 13, 2006

(65) Prior Publication Data

US 2008/0061499 A1 Mar. 13, 2008

(51) Int. Cl.
*B65H 9/04* (2006.01)

(52) U.S. Cl. ..... 271/242; 271/273; 271/228; 271/252

(58) Field of Classification Search ..... 271/242, 271/245, 228, 272, 273, 252, 253
See application file for complete search history.

(56) References Cited

U.S. PATENT DOCUMENTS 3,980,295 A * 9/1976 Kleid ..... 271/242
4,805,892 A 2/1989 Calhoun
5,078,384 A 1/1992 Moore
5,156,391 A 10/1992 Roller
5,219,159 A * 6/1993 Malachowski et al. ..... 271/228
5,246,224 A * 9/1993 Matsuno et al. ..... 271/242
5,253,862 A 10/1993 Acquaviva et al.
5,632,478 A 5/1997 Quesnel et al.
5,775,690 A 7/1998 Quesnel et al.
5,921,545 A * 7/1999 Kobayashi et al. ..... 271/242
6,059,285 A * 5/2000 Suga et al. ..... 271/228
6,135,446 A * 10/2000 Thiemann et al. ..... 271/228
6,634,521 B1 * 10/2003 Hwang ..... 221/228
6,955,349 B2 * 10/2005 Watase ..... 271/242
6,974,128 B2 12/2005 Quesnel
7,401,776 B2 * 7/2008 Obuchi et al. ..... 271/228
2003/0151191 A1 * 8/2003 Watase ..... 271/242
2004/0094891 A1 * 5/2004 Trovinger et al. ..... 271/227
2005/0230906 A1 10/2005 Loiselle

* cited by examiner

*Primary Examiner*—Kaitlin S Joerger

(57) ABSTRACT

A stalled roll registration system and method includes a mechanism that allows for pivoting deskew action in a pre-registration nip in the form of a segmented pre-registration drive roll assembly mounted on a releasable low friction lateral translation carriage. Outer pre-registration idler nips are provided that open to allow a sheet to pivot and close for transport the sheet. The pre-registration idlers are engaged and the drive roll assembly remains locked in the lateral position for initial paper transport up to the stalled registration roll. After the sheet arrives at the stalled registration roll and starts to form a buckle for deskew, the outer pre-registration idlers and carriage are released. The body of the sheet is then free to pivot about the center drive nip and translate in the lateral direction to self align itself with the registration roll.

19 Claims, 6 Drawing Sheets

PRE-REGISTRATION APPARATUS

This disclosure relates generally to sheet registration devices, and more particularly, to a pivoting and translating pre-registration apparatus for use in a stalled roll registration system.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, it is necessary to align and register the individual cut sheet so that the developed image is placed in the proper location on the sheet. Various schemes have been developed to assure that the image-receiving sheet is in the proper location and forwarded at the proper time. Some complex printing machines utilize various sensors and translating nips to align the sheet in the proper position for receiving the image. Other machines utilize variable speed stepping motors to differentially drive a sheet within a sheet path for deskew and registration purposes. Both of these registration methods require sophisticated control and are relatively high cost.

Another method for registering and aligning a sheet is the use of stalled rolls. In the stalled roll technique, a sheet is continuously driven by a set of pre-registration nips into a nip in which the rolls are momentarily stopped causing a buckle to be formed between the stalled roll and the driving rolls. The force of the buckle causes the lead edge of the sheet to align itself within the stalled nip and the stalled nip is then activated so that the sheet is forwarded in the proper aligned position. Other systems utilize a stalled roll with a solenoid actuated drive nip in which the drive nip precedes the stalled roll so that the sheet is free to deskew in the stalled nip. While simpler than the active registrations described previously, the stalled roll technique with solenoid actuated nip still requires a solenoid to deactivate the drive nip. Other problems arise if the buckle in a stalled roll system gets too large which can then cause the registration force to decrease and the lead edge of the sheet to back out of the nip causing skew.

It is desirable to have a stalled roll registration device in which a sheet could be deskewed and registered within the stalled nip and then secured prior to being forwarded in timed registration to a subsequent machine subsystem.

In U.S. Pat. No. 5,253,862 to Acquaviva et al., issued Oct. 19, 1993, a sheet handler is disclosed that includes an idler and driven cross roller set. The rollers are preloaded so that a normal force exists between the rollers at the nip. The nip is provided with an apparatus for adjusting the preloaded force to adjust the normal force on the sheet material passing through the nip.

A method and apparatus for deskewing and registering a sheet in a short paper path is shown in U.S. Pat. No. 5,156, 391, issued Oct. 20, 1992 to Roller, by differentially driving two sets of rolls so as to create a paper buckle buffer zone in the sheet and then differentially driving a roll set to correct skew while the sheet is still within the nips of multiple drive roll sets.

U.S. Pat. No. 5,078,384, issued Jan. 7, 1992 to Moore, discloses a method and apparatus for deskewing and registering a sheet, including the use of two or more selectably controllable drive rolls operating in conjunction with sheet skew and lead edge sensors for frictionally driving and deskewing sheets having variable lengths. Sheets will be advanced to reach a predetermined registration position at a predetermined velocity and time at which time the sheets will no longer be frictionally engaged by the drive rolls.

A two step optimized stalled roll registration and deskew system is shown in U.S. Pat. No. 5,775,690, issued Jul. 7, 1998, that includes a drive mechanism preceding a stalled roll pair and a sensor to determine the size of a buckle formed in a sheet as it is fed into the registration nip formed by the stalled roll pair. When the buckle reaches a predetermined size the sensor generates a signal which causes the drive controller to briefly pulse the registration roll pair. This brief pulse of the registration roll pair captures the sheet in the nip in a deskew and registered position for subsequent feeding in a timed relationship to a machine subsystem. A baffle located between the drive nip and registration nip directs the sheet buckle formation in a controlled manner so that proper deskewing and registration forces are obtained.

U.S. Pat. No. 5,632,478, issued May 27, 1997 to Lisbeth S. Quesnel, describes a stalled roll registration device in which there is provided a drive mechanism preceding the stalled roll which allows a sheet to move while within the drive nip. The drive mechanism uses a drive roll and an eccentric idler roll in contact therewith. The idler is biased against the drive roll by a compression spring such that as the eccentric idler roll rotates, the spring is alternately compressed and relaxed. When a sheet is driven through the drive mechanism and into the stalled nip, a buckle is formed which causes a force to be exerted on the drive nip, which causes the eccentric roll to stall in the horizontal position in which little normal force is exerted on the sheet. The sheet is then free to deskew and align in the stalled nip.

U.S. Pat. No. 4,805,892, issued Feb. 21, 1989 to Lee M. Calhoun, describes a cross-track registration device for a sheet transport system that uses gears to allow downstream cross-track movement of a sheet despite engagement of the sheet with upstream rollers.

U.S. Pat. No. 6,974,128 B2, issued Dec. 13, 2005 to Lisbeth S. Quesnel, describes a sheet registration system in an arcuate sheet path of a compact printer with a sheet feeding system in which the lead edge of the sheet is partially arcuately buckled against a transversely extending registration gate. A transversely variable arcuate control baffle system is positioned upstream of the registration gate for accommodating skewed sheets in the sheet path to provide improved alignment of the sheet lead edge of a skewed sheet.

United States Patent Application Publication No. US 2005/0230906 A1, published Oct. 20, 2005, now U.S. Pat. No. 7,128,318, discloses a sheet registration system that includes an intermediately transversely pivotal baffle member overlying and engaging at least part of a buckled sheet being edge registered so that the effective buckle chamber size and sheet path length on one side of the sheet is automatically different from the other side of the sheet with the pivoting of the pivotal baffle member, to assist in the deskewing of the sheet as it is being partially buckled by the sheet registration system. The direction and amount of baffle pivoting may be self-pivoted by the extent of transverse buckle difference, or positively driven in response to a detected sheet skew.

The entire above-mentioned prior art is included herein by reference to the extent necessary to practice the present disclosure.

Even though the above-mentioned registration and deskewing systems are quite useful, there is still a need to remove large amounts of sheet input skew that cannot be removed by the standard stalled roll system.

Accordingly, pursuant to the features of the present disclosure, an improved stalled roll registration and deskew system is disclosed that answers the above-mentioned problem by providing a segmented pre-registration drive roll assembly mounted on a releasable low friction lateral translation carriage. Nip release pre-registration outer idler nips are included to assist in transporting a sheet toward registration. The pre-registration idlers are engaged and the drive roll assembly remains locked in the lateral position for initial sheet transport up to the momentarily stalled registration roll. After the sheet arrives at the stalled registration roll and starts to form a buckle for deskew, the outer pre-registration idlers and carriage are released. The body of the sheet is then free to pivot about the center drive nip and translate in the lateral direction to self align itself with the registration roll.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

While the present disclosure will be described in connection with a preferred embodiment thereof, it will be understood that it is not intended to limit the disclosure to that embodiment. On the contrary, it is intended to cover all alternatives, modifications, and equivalents as may be included within the spirit and scope of the disclosure as defined by the appended claims.

Figure 1:
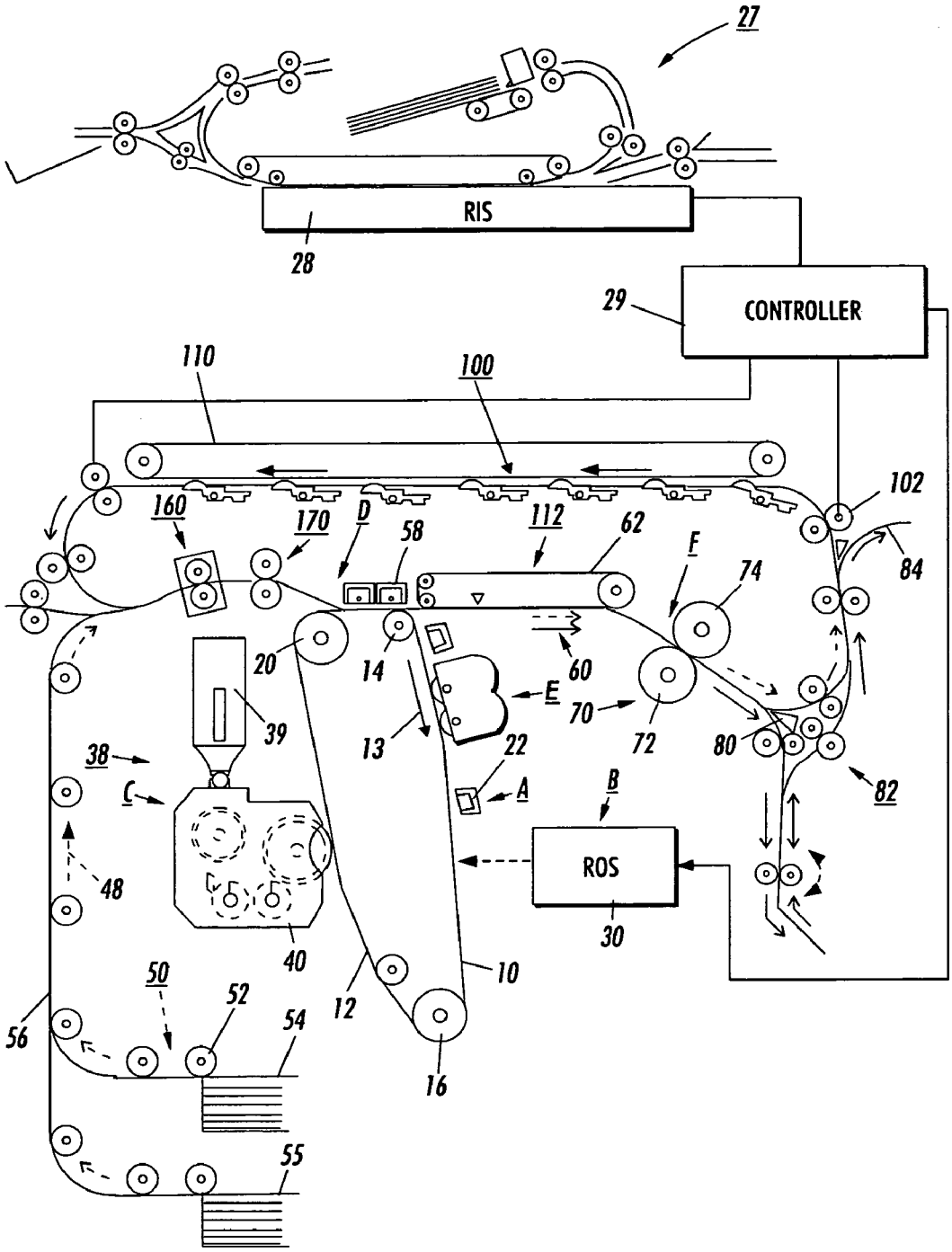
FIG. 1 is a schematic elevational view of a typical electrophotographic printing machine utilizing the sheet deskew and registration device of the present disclosure.

For a general understanding of the features of the present disclosure, reference is made to the drawings. In the drawings, like reference numerals have been used throughout to identify identical elements. FIG. 1 schematically depicts an electrophotographic printing machine incorporating the features of the present disclosure therein. It will become evident from the following discussion that the stalled roll registration device of the present disclosure may be employed in wide variety of devices and is not specifically limited in its application to the particular embodiment depicted herein. For example, the pre-registration apparatus of the present disclosure can be used in document handlers, if desired.

FIG. 1 illustrates an original document positioned in a document handler 27 on a raster input scanner (RIS) indicated generally by the reference numeral 28. The RIS contains document illumination lamps; optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine, which generally employs a photoconductive belt 10. Preferably, the photoconductive belt 10 is made from a photoconductive material coated on a grounded layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example, a raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by raster basis.

After the electrostatic latent image has been recorded on photoconductive surface 12, belt 10 advances the latent image to a development station C, where toner, in the form of liquid or dry particles, is electrostatically attracted the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station D, by a sheet feeding apparatus, 50. Preferably, sheet feeding apparatus 50 includes a feed rolls 52 and 53 contacting the uppermost sheet of stacks 54 and 55, respectively. Feed roll 52 rotates to advance the uppermost sheet from stack 54 into vertical transport 56. Vertical transport 56 directs the advancing sheet 48 of support material into pre-registration device 160 which in conjunction with stalled roll registration mechanism 170 moves a now registered sheet 48 past image transfer station D to receive an image from photoreceptor belt 10 in a timed sequence so that the toner powder image formed thereon contacts the advancing sheet 48 at transfer station D. Transfer station D includes a corona generating device 58, which sprays ions onto the back side of sheet 48. This attracts the toner powder image from photoconductive surface 12 to sheet 48. After transfer, sheet 48 continues to move in the direction of arrow 60 by way of belt transport 62, which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roll 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor, which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
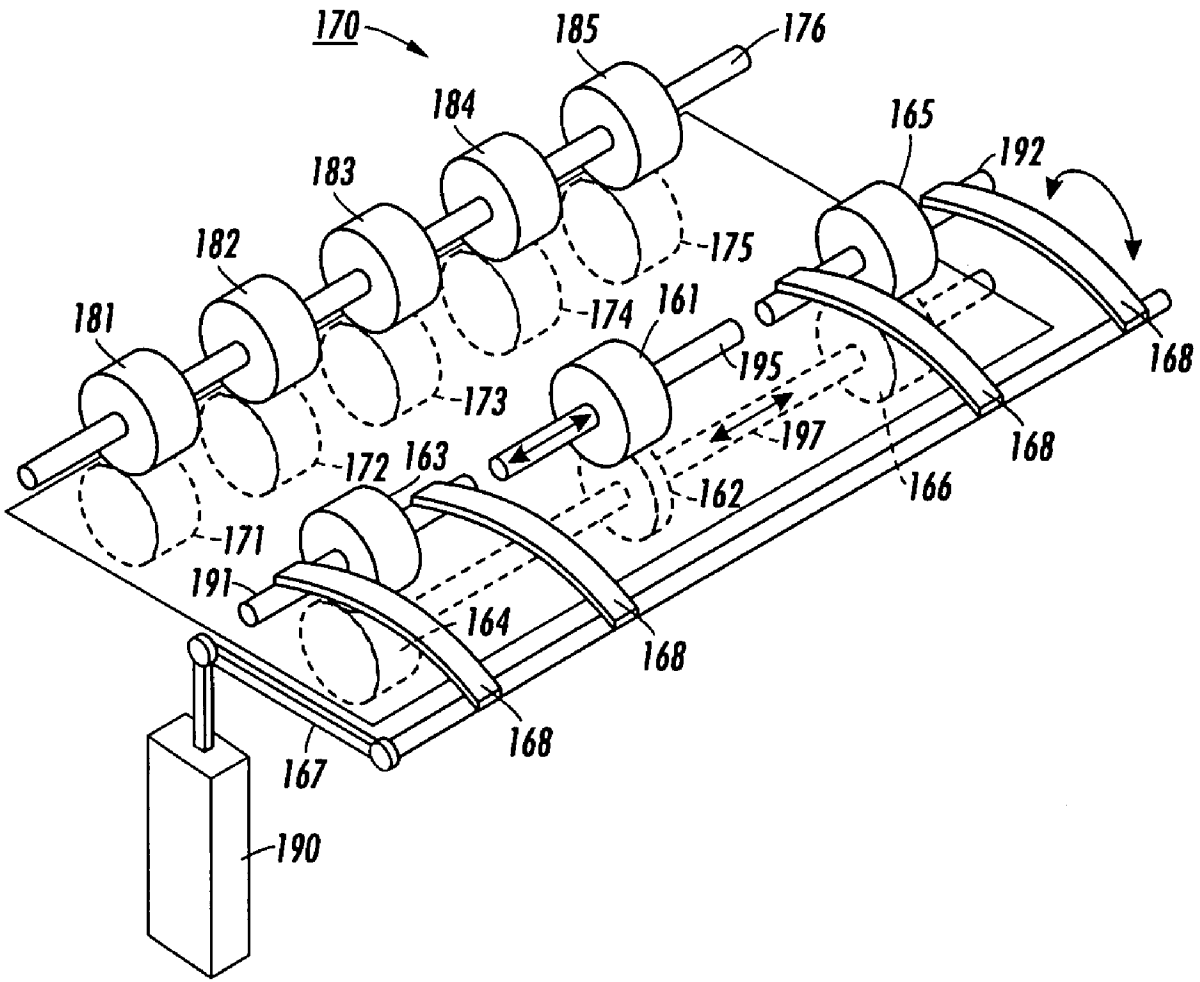
FIG. 2 is a partial schematic plan illustration of the deskew stalled roll registration system in FIG. 1 showing a sheet being registered by a pre-registration apparatus.

In accordance with an aspect of the present disclosure as shown in FIG. 2, an improved stalled roll pivoting deskew registration system comprises a stalled nip at registration in combination with a low cost pre-registration drive assembly 170. A stalled roll registration nip is formed between drive rollers 171, 172, 173, 174 and 175 mounted on a shaft (not shown) and shaft 176 mounted idler rollers 181, 182, 183, 184 and 185, respectively, positioned to form a nip with the driver rollers. A pre-registration device that facilitates pivoting and translating of a sheet includes carriage 200 shown in FIG. 3 and a segmented pre-registration drive roll 162 that mates with an idler roll 161 to drive sheets 48 into the stalled roll registration nip in order to deskew them in the direction of arrow 169 in FIG. 3. Outer nip idlers formed by releasable idler rolls 163 and 165 are mounted on shafts 191 and 192 attached to a sub-frame of printer 10. Releasable idlers 163 and 165 are engaged with 164 and 166 of carriage 200 by springs 168 which could be, for example, leaf springs.

Figure 3:
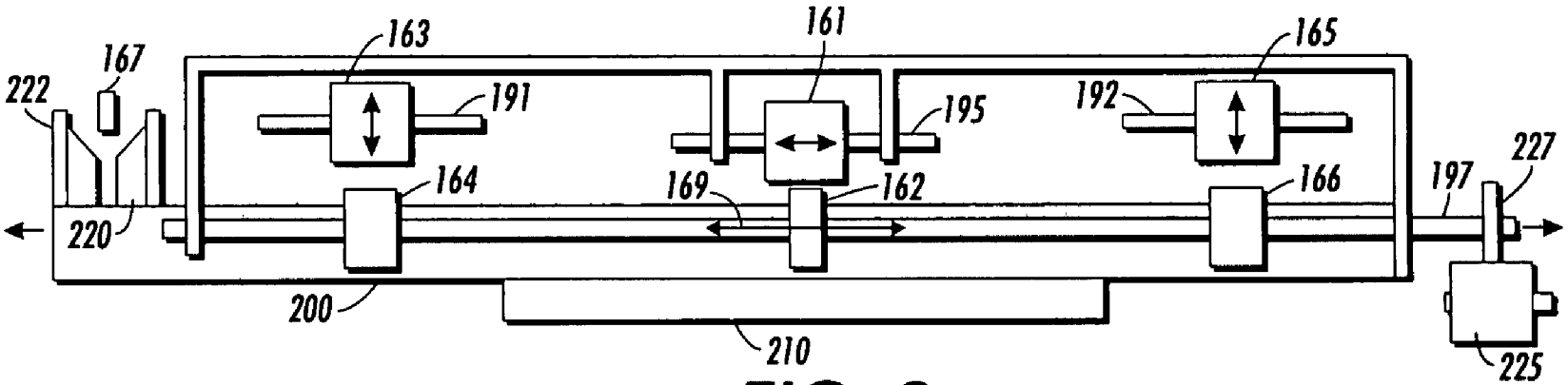
FIG. 3 is a partial front view of the pre-registration apparatus of FIG. 2 showing a linear slide mounted translatable carriage.

Carriage 200 in FIG. 3 is mounted on a conventional linear ball roller slide 210 and is translated left and right in the direction of arrow 169 by the differential buckle developed in a sheet as the sheet is driven into the stalled roll registration nip by registration drive roll 162. Drive to drive rolls 162, 164 and 166 are provided by drive transfer gears 225 and 227. As shown, actuator arm 167 is removed from upstanding arms 220 and 222 and has positioned idlers 163 and 165 in an open position that allows a sheet to pivot about the nip formed between drive roll 162 and idler roll 161 as it is driven into the stalled roll registration nip.

Figure 4:
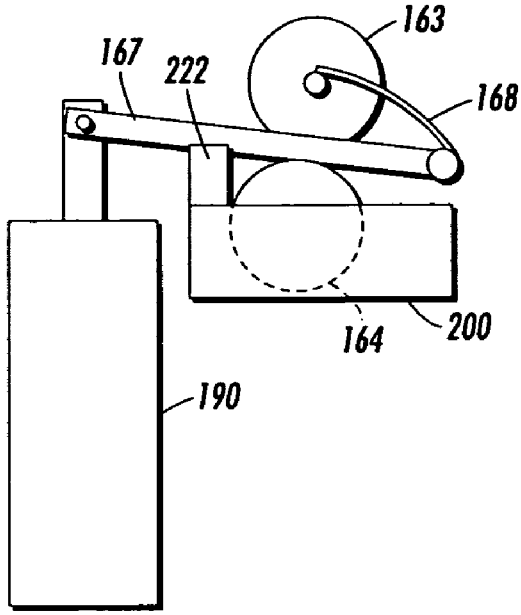
FIG. 4 is a partial schematic side view of the pre-registration apparatus of FIG. 2 showing the mechanism used to locate a translatable carriage and close outer idler nips positioned in an actuator OFF position.
Figure 6:
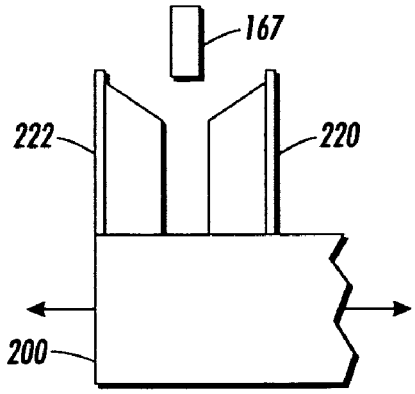
FIG. 6 is a partial schematic elevation view of the mechanism of FIG. 4 showing an actuator arm in a carriage release position.

In FIG. 4, an actuator 190 is connected to idlers 163 and 165 through an actuator arm 167 and pivotable nip loading spring 168. The actuator, arm pivotable spring and outer idler assembly are attached to a stationary frame or sub-frame of printer 10. Actuator 190 is shown in an OFF position in FIG. 4 which opens the nip between idler 163 and drive 164. The same is true for the idler 165 and its complimentary idler 166 located on the opposite side of pre-registration drive roll 162. In this position of actuator arm 167, carriage 200 is released from V grooves of upstanding members 220 and 222 shown in FIG. 6 and is freely movable laterally due to movement of a sheet driven by pre-registration drive roll 162 into the stalled roll registration nip as the sheet deskews itself at the nip.

Figure 5:
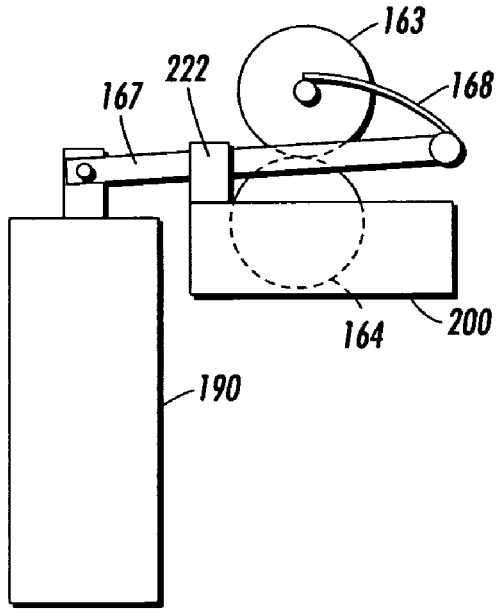
FIG. 5 is a partial schematic side view of the mechanism of FIG. 4 positioned in an actuator ON position.
Figure 7:
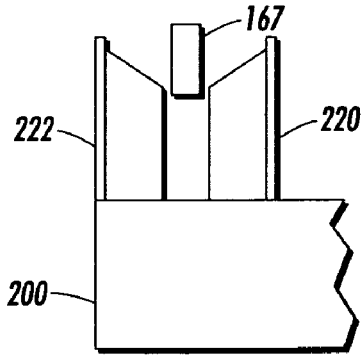
FIG. 7 is a partial schematic elevation view of the mechanism of FIG. 5 showing an actuator arm in a carriage lock position.
Figure 8:
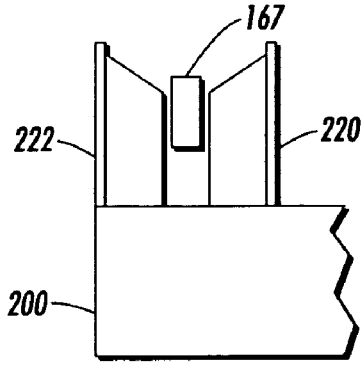
FIG. 8 is a partial schematic elevation view of the mechanism of FIG. 5 showing an actuator arm in a carriage lock position and outer nip idlers engaged position.

In FIG. 5, actuator 190 is shown in an ON position which closes the nip between idler 163 and drive roll 164 and engages the nip idlers with normal force. When actuator 190 is OFF as shown in FIG. 4, translatable carriage 200 and outer nip idlers 163 and 165 are released and carriage 200 is free to move laterally as shown in FIG. 3 since actuator arm 167 is now positioned above upstanding arms 220 and 222 of carriage 200. In FIG. 7 carriage 200 is centered and locked and outer nip idlers 163 and 165 make contact because actuator arm is now positioned between upstanding arms 220 and 222 of carriage 200. Continued movement of actuator 190 as shown in FIG. 8 causes actuator arm 167 to move further in between upstanding arms 220 and 222 of carriage 200 causing the carriage to become locked and the outer nip idlers to become engaged with normal force. Since the carriage is always in the "home" position during outer nip loading, the carriage release, outer idlers and engagement mechanism may be mounted to the sub-frame.

Figure 9:
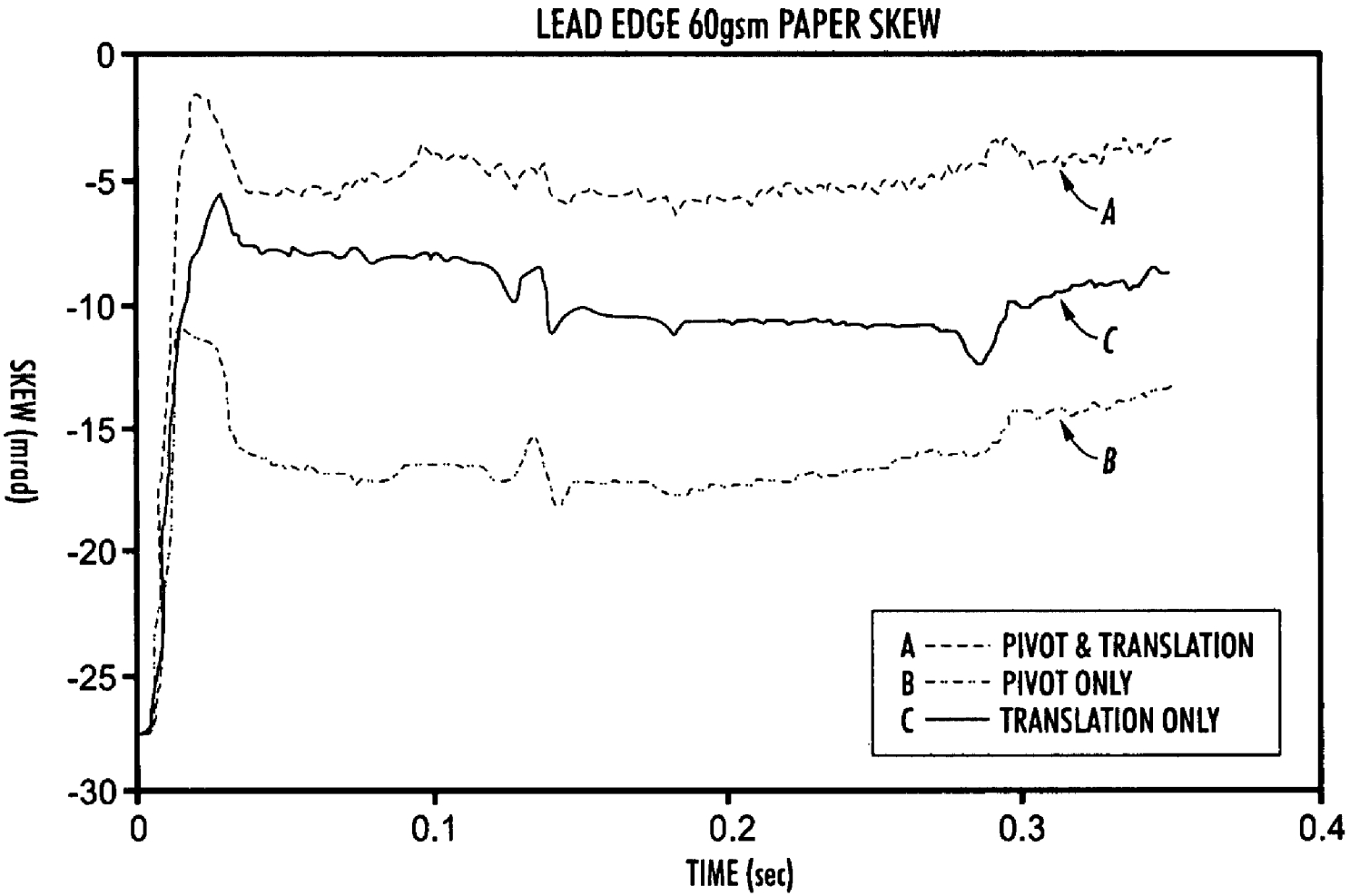
FIG. 9 is a diagram showing lead edge skew performance with pre-registration devices that translate and pivot, pivot only, or translate only.

A diagram of the correction of skew with devices that allow a sheet to pivot and translate, pivot only and translate only is shown in FIG. 9. As indicated, controlling lead edge sheet skew of about −25 (mrad) over a 0.3 second time period is significantly improved when using a device that includes pivoting and translation of a sheet in a pre-registration nip over using one with either pivot only or translation only.

In operation, the pre-registration idlers are engaged and the translating carriage assembly including the drive roll and center nip idler assembly is locked in a central fixed location in the lateral direction for initial sheet transport up to the stalled roll registration nip(s). This is done by use of a solenoid that positions and locks the carriage through a V groove and provides nip loading to the outer drive nips. This maintains accurate position control of the sheet for delivery to registration. After the sheet arrives at the stalled roll registration roll and starts to form a buckle for deskew, the solenoid is released thereby releasing the outer pre-registration idlers and freeing the carriage. The body of the sheet is then free to pivot about the narrow sole center drive nip and translate in the lateral direction to self align itself with the registration roll (allowing the tail to wag). The buckle formation is maintained by the center pre-registration drive nip to provide sufficient lead edge force at the registration nip prior to roll engagement and then provides drive isolation through transfer with nearly all differential buckle and associated sheet stress eliminated, thus resulting in greatly increased media deskew latitude and improved sheet motion quality through transfer across all media sizes and weights.

It should now be understood that a method and apparatus for relieving the differential buckle strain in a sheet once the lead edge of the sheet has arrived at a stalled roll registration nip and buckle formation and the deskew process has begun and includes a segmented pre-registration drive roll assembly with nip release for outer nips mounted on a releasable low friction lateral translation carriage.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An apparatus for registering a sheet in a path, comprising:

a stalled roll registration nip located in the path; and an input pre-registration transport that facilitates sheet pivoting therein, said pre-registration transport including a shaft mounted drive roll and mating idler roll for driving the sheet into said stalled roll registration nip, a translatable carriage, said shaft of said drive roll being mounted on said translatable carriage, and releasable idler roll nips positioned on opposite sides of said drive roll, and wherein said releasable idler rolls are adapted to release from mating with said drive roll at a predetermined time in order to allow the sheet to twist within said nip formed between said drive roll and said mating idler roll and register against said stalled roll registration nip.

2. The apparatus of claim 1, wherein said idler roll nips open and close depending upon the location of said translatable carriage.

3. The apparatus of claim 2, wherein said idler roll nips are controlled by an actuator.

4. The apparatus of claim 3, wherein said actuator is connected to said idler roll nips by an actuator arm and a nip loading spring.

5. The apparatus of claim 4, wherein movement of said actuator arm causes said idler roll nips to move from a spaced apart position to a contacting position.

6. The apparatus of claim 5, wherein said translatable carriage is in a locked position when said actuator is ON and an unlocked position when said actuator is OFF.

7. The apparatus of claim 6, wherein said translatable carriage includes upstanding V-shaped grooved members, and wherein said translatable carriage is locked when said actuator arm is positioned within said V-shaped grooved members.

8. The apparatus of claim 7, wherein said actuator is a solenoid.

9. A reprographic device in which a sheet is driven along a path and fed in a timed relationship and registered position to a process station, comprising:

a registration nip located in the path; and an input pre-registration transport that facilitates sheet pivoting therein, said pre-registration transport including a shaft mounted drive roll and at least one mating idler roll for driving the sheet into said registration nip, a translatable carriage, and wherein said shaft of said drive roll is mounted on said translatable carriage, and wherein said translatable carriage is translated after the sheet arrives and begins to form a buckle at said registration and including releasable idler roll nips positioned on opposite sides of said drive roll, and wherein said idler roll nips are released as said buckle begins to form.

10. The reprographic device of claim 9, wherein said idler roll nips are controlled by an actuator.

11. The reprographic device of claim 10, wherein said actuator is connected to said idler roll nips by an actuator arm and a nip loading spring.

12. The reprographic device of claim 11, wherein movement of said actuator arm causes said idler roll nips to move from a spaced apart position to a contacting position.

13. The reprographic device of claim 12, wherein said translatable carriage is in a locked position when said actuator is ON and an unlocked position when said actuator is OFF.

14. The reprographic device of claim 12, wherein said translatable carriage includes upstanding V-shaped grooved members, and wherein said translatable carriage is locked when said actuator arm is positioned within said V-shaped grooved members.

15. A method for registering a sheet transported in a path to a downstream registration location, comprising:

providing a registration nip located in the path;

forming a buckle at said registration nip;

providing an input pre-registration transport that facilitates sheet pivoting therein, said pre-registration transport including a shaft mounted drive roll and mating idler roll for driving the sheet into said registration nip, a translatable carriage, said shaft of said drive roll being mounted on said translatable carriage, and releasable idler roll nips positioned on opposite sides of said drive roll, and translating said translatable carriage after the sheet arrives and begins to form a buckle at said registration nip.

16. The method of claim 15, including opening and closing said idler roll nips depending upon the location of said translatable carriage.

17. The method of claim 16, including controlling said idler roll nips with an actuator.

18. The method of claim 17, including connecting said actuator to said idler roll nips by an actuator arm and a nip loading spring.

19. The method of claim 18, including controlling said actuator arm with a solenoid.

* * * * *